US005754932A

United States Patent [19]

Tahara

[11] Patent Number: 5,754,932

[45] Date of Patent: May 19, 1998

[54] IMAGE FORMING APPARATUS HAVING CONVEY BELT

[75] Inventor: Motoaki Tahara, Yokohama, Japan

[73] Assignee: Canon Kabushiki Kaisha, Tokyo, Japan

[21] Appl. No.: 637,343

[22] Filed: Apr. 25, 1996

[30] Foreign Application Priority Data

Apr. 28, 1995 [JP] Japan ..... 7-106487

[51] Int. Cl.[6] ..... G03G 15/01

[52] U.S. Cl. ..... 399/303; 399/299; 399/312; 399/395

[58] Field of Search ..... 399/66, 165, 297, 399/298, 299, 301, 303, 310, 311, 312, 313, 316, 388, 394, 395; 198/807, 806

[56] References Cited

U.S. PATENT DOCUMENTS 3,715,027 2/1973 Fujimoto .
4,557,372 12/1985 Rajagopap ..... 198/807
5,041,877 8/1991 Matsumoto ..... 399/66
5,225,877 7/1993 Wong ..... 399/165 X
5,404,202 4/1995 Abramsohn ..... 399/395 X
5,581,327 12/1996 Izumizaki et al. ..... 399/299 X

*Primary Examiner*—Sandra L. Brase
*Attorney, Agent, or Firm*—Fitzpatrick, Cella, Harper & Scinto

[57] ABSTRACT

An image forming apparatus comprises a convey belt for bearing and conveying a recording material, image forming means for forming an image on the recording material born on the convey belt, a detection means for detecting a position of the convey belt in a direction perpendicular to a recording material conveying direction provided by the convey belt, count means for effecting a counting operation in accordance with a detection output from the detection means, rocking means for rocking the convey belt in the direction perpendicular to the recording material conveying direction, and control means for controlling a rocking operation of the rocking means on the basis of a counted value from the count means.

17 Claims, 14 Drawing Sheets

105
CCD
302
A/D & S/H
303
SHADING CKT.
304
INPUT MASKING CKT.
305
MAGNIFICATION CKT.
320
321
322
TO FIG. 3B
317
BUS SELECTOR
318
COMMUNICATION CKT. FOR SIMULTANEOUS DRIVING
323
VCLK
HSYNC
VE
EXTERNAL BUS
326
31
27
8
3
327
OTHER APPARATUS
328
OTHER APPARATUS

| NUMBER OF MOTOR OPERATION | 0 | 1st | 2nd | 3rd | 4th | 5th | 6th |
|---|---|---|---|---|---|---|---|
| THRESHOLD | 0 | 50 | 150 | 400 | 700 | 1050 | 1450 |

IMAGE FORMING APPARATUS HAVING CONVEY BELT

BACKGROUND OF THE INVENTION

1. Field of the Invention

The present invention relates to an image forming apparatus having a convey belt for bearing and conveying a recording material, and more particularly, it relates to an image forming apparatus suitable to be applied to a color copying machine, a laser beam printer and the like, in which images formed on a plurality of image bearing members are transferred onto a recording material born by a convey belt in a superimposed fashion.

2. Related Background Art

FIG. 16 is a sectional view of a conventional image forming apparatus (for example, digital color copying machine).

In the digital copying machine, a latent image is formed on a photosensitive drum 1301 by laser exposure 1303, and then, the latent image is developed by color toner to form a visualized toner image. The developed toner image is transferred onto a transfer sheet (recording material) born on a transfer drum 1302. By repeating operation from the laser exposure process to the transfer process in color order (yellow, magenta, cyan and black), a full-color image is formed on the. transfer sheet by superimposing the color toner images. In such an apparatus, since the transfer sheet is fixed to the transfer drum 1302, when the color toner images are transferred onto the transfer sheet in the superimposed fashion, there is no color deviation in a main scan direction.

However, in image forming apparatuses in which a plurality of photosensitive members are disposed side by side and images formed on the photosensitive members are successively transferred onto a transfer sheet conveyed by a transfer belt to obtain a full-color image, since the image is transferred onto the transfer sheet while always forming the images on the plurality of photosensitive members, after belt deflection along a direction perpendicular to a transfer sheet conveying direction is detected, if a belt deflection direction is abruptly changed, positions on which the color toner images are transferred are changed, with the result that the color deviation occurs in the direction perpendicular to the transfer sheet conveying direction, thereby deteriorating the image.

SUMMARY OF THE INVENTION

An object of the present invention is to provide an image forming apparatus which can prevent image-shift (color deviation) which may be caused when a rocking direction of a convey belt is changed in a direction perpendicular to a recording material conveying direction.

Another object of the present invention is to provide an image forming apparatus which can rock a convey belt not to cause image-shift on a recording material born on a convey belt.

The other objects and features of the present invention will be apparent from the following detailed explanation of the invention referring to the accompanying drawings.

DETAILED DESCRIPTION OF THE PREFERRED EMBODIMENTS

An embodiment of an image forming apparatus according to the present invention will now be explained with reference to the accompanying drawings.

[Image Forming Process]

Figure 1:
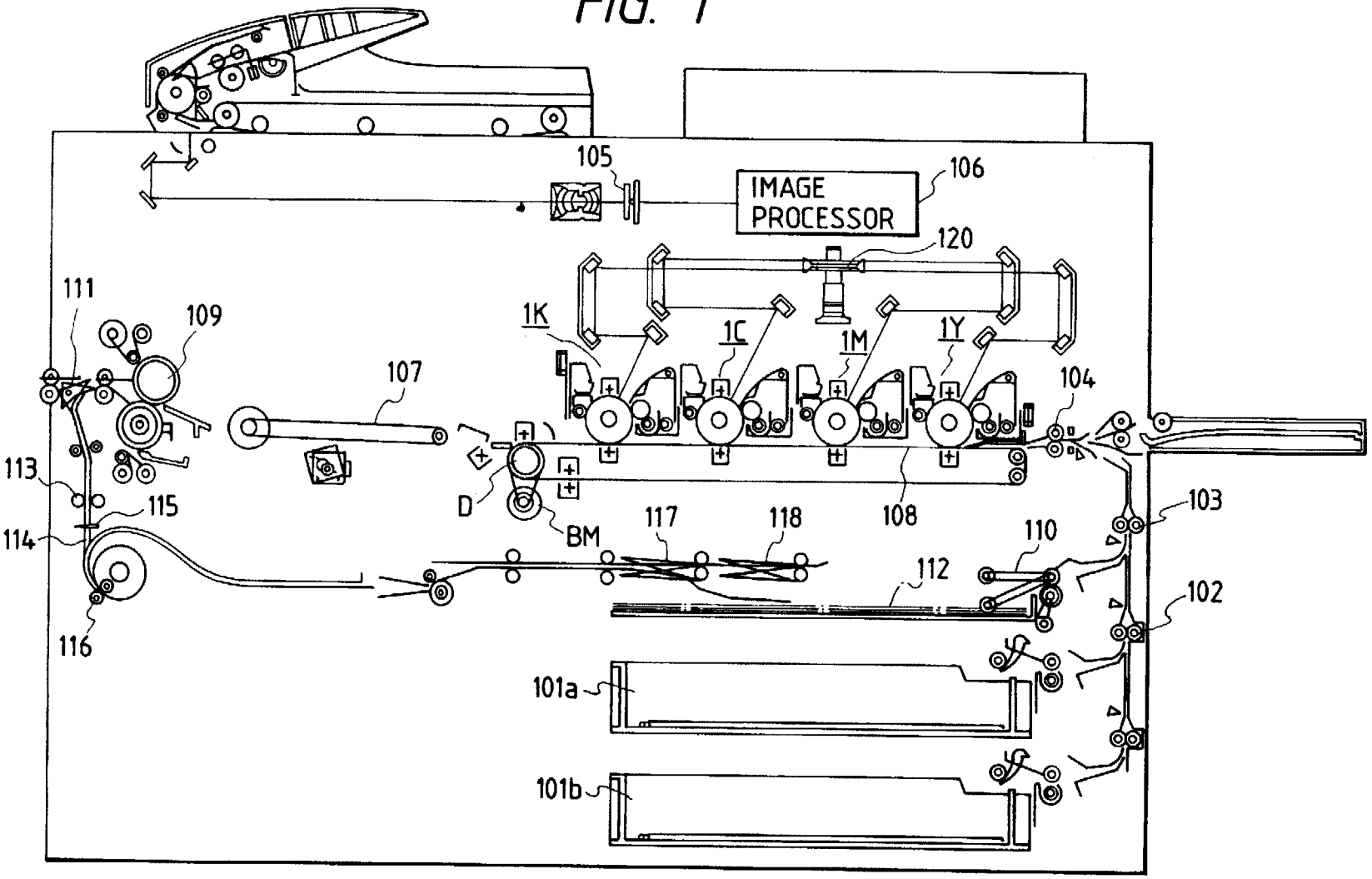
FIG. 1 is an explanatory view showing an image forming apparatus according to a preferred embodiment of the present invention.

FIG. 1 schematically shows an image forming apparatus according to a preferred embodiment of the present invention. In this embodiment, the digital image forming apparatus for forming a full-color image by using four colors, i.e., yellow, magenta, cyan and black and includes four image forming stations 1Y, 1M, 1C, 1K which correspond to yellow, magenta, cyan and black, respectively and which are disposed side by side.

Figure 2:
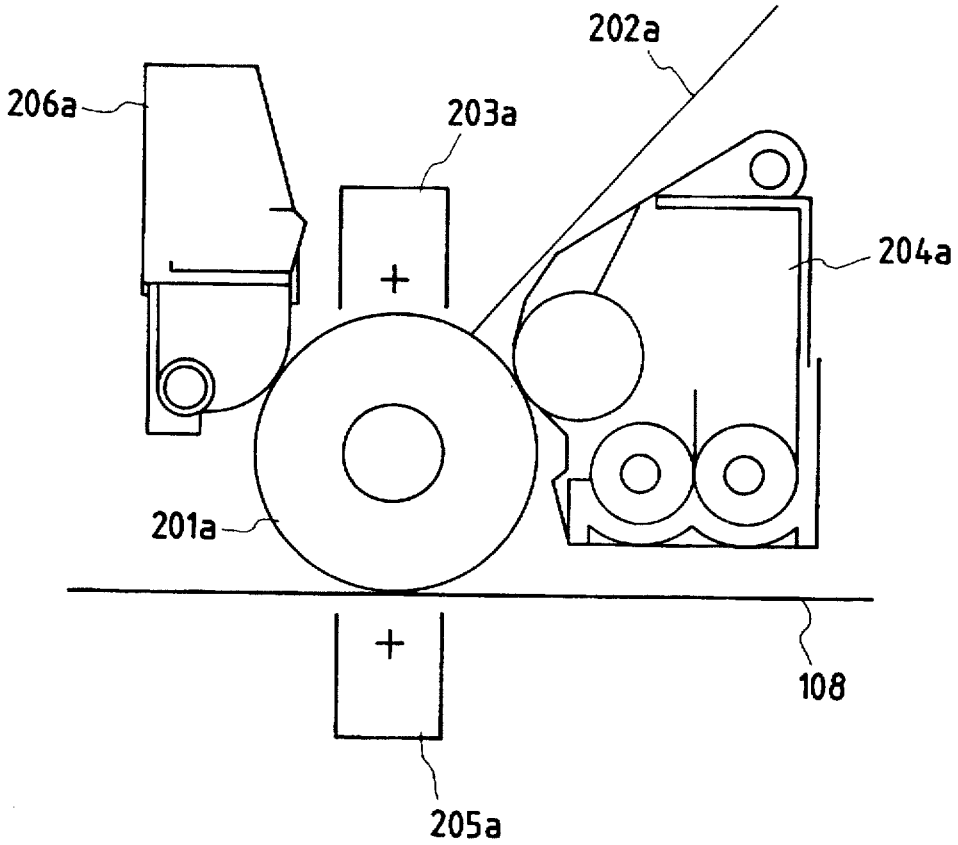
FIG. 2 is a sectional view for explaining an image forming process of an image forming station of the image forming apparatus of FIG. 1.

FIG. 2 is a sectional view for explaining an image forming process of the image forming station shown in FIG. 1. Now, the image forming process will be explained with reference to an yellow image forming station as an example.

In the yellow image forming station, a photosensitive drum (image bearing member) 201*a* is uniformly charged by a first high voltage charger and grid high voltage unit 203*a*. After the charging, in response to image information, the photosensitive drum 201*a* is exposed by laser light scanned by a laser scanner 120 to form a latent image for an yellow image. Then, the latent image corresponding to the yellow image information is developed by a developing device 204*a* including yellow color toner to form an yellow toner image. The toner image is transferred onto a transfer material (transfer sheet) born on a recording material transfer belt, i.e., convey belt (recording material convey means) 108 by a transfer charger 205*a*.

Residual toner remaining on the yellow photosensitive drum is removed by a cleaning device 206*a*. Incidentally, similar image forming processes are performed in the magenta, cyan and black image forming stations 1M, 1C, 1K, but, detailed explanation thereof will be omitted.

[Both-Face Image Forming Sequence]

A both-face image forming sequence of the image forming apparatus will be described referring to an example that the transfer sheet is supplied from an upper cassette.

As soon as an image formation start signal is emitted, a first sheet supply roller solenoid (not shown) is turned ON so that the transfer sheet P starts to be supplied from a sheet supply cassette 101*a*. The transfer sheet P supplied from the sheet supply cassette 101*a* is conveyed by pairs of convey rollers 102, 103 to reach a first pair of regist rollers 104. The transfer sheet 9 is temporarily stopped when a predetermined loop is formed in the sheet after a tip end of the sheet abuts against a nip of the regist rollers 104.

On the other hand, at the same time when the image formation start signal is emitted, an original on a platen is read by a CCD 105, and an image signal corresponding to the read image is sent to an image process portion 106. When image data read in an image memory of the image process portion 106 becomes a laser scan permitting condition, the first pair of regist rollers 104 start to be rotated.

By rotation of the regist rollers, the transfer sheet P is conveyed to a predetermined position on the transfer belt 108 and is adhered to there for image formation.

As mentioned above, the different color toner images are transferred onto the transfer sheet P. In this case, the image information of the original is written on the respective photosensitive drums at such timings that the toner images are successively transferred onto the transfer sheet P in a superimposed fashion when the transfer sheet P passes through the yellow, magenta, cyan and black image forming stations 1Y, 1M, 1C and 1K, respectively.

The transfer sheet P which was passed through four image forming stations successively and to which four toner images were transferred in the superimposed fashion is then conveyed by a pre-fixing convey belt 107 to a fixing device 109, where the toner images are fixed.

On the other hand, in a both-face copy mode, at the same time when the image formation start signal is emitted, a sheet re-supply pick-up roller solenoid (not shown) is turned ON to lift a sheet re-supply roller 110 for preparing for both-face image formation. Further, a sheet convey path deflection plate solenoid (not shown) is also turned ON, with the result that a first sheet deflection plate 111 is operated to form a sheet convey path for the both-face image formation. At the same time, a sheet stopper solenoid SL (not shown) associated with an intermediate tray portion 112 is turned ON, with the result that a sheet stopper plate (not shown) in the intermediate tray portion is operated.

After the fixing operation regarding a first surface of the transfer sheet is finished, the transfer sheet P is conveyed by the first sheet deflection plate 111 to a pair of convey rollers 113 through a both-face convey path. When the transfer sheet P is passed through a sheet reverse rotation detection sensor 115 disposed in the vicinity of a switch-back portion (sheet reverse rotation portion) 114, a reversible roller 116 is rotated in a reverse direction.

As a result, the transfer sheet P is switched-back to be conveyed to a second convey portion. Sheet size deflection plates 117, 118 serve to change the transfer sheet convey path to the intermediate tray 112 by driving a sheet deflection plate solenoid SL7 or SL8 (not shown).

When the first transfer sheet P is conveyed into the intermediate tray, the sheet re-supply pick-up solenoid (not shown) is turned OFF temporarily, thereby lowering the rotating sheet re-supply roller 110 on the transfer sheet P. As a result, the transfer sheet P abuts against the sheet stopper plate (not shown).

By the above-mentioned series of operations, the transfer sheets each having a first surface on which the image was formed are successively stacked on the intermediate tray 112 for preparation for second surface image formation.

In a condition that the sheet re-supply roller 110 is lowered and contacted with an upper surface of the transfer sheets 9 stacked on the tray 112, when a second surface image formation start signal is emitted, the second surface image formation is started. That is to say, a sheet re-supply clutch (not shown) is turned ON to rotate the sheet re-supply roller 110, thereby re-supplying one transfer sheet P in the tray from an uppermost one. When the first transfer sheet P is re-supplied, the sheet re-supply roller 110 is lifted.

And, when the re-supply of the first transfer sheet P is finished, the rotating sheet re-supply roller 110 is lowered at a predetermined timing to supply a next (second) transfer sheet. The sheet re-supply roller 110 repeats such lifting and lowering movements. The re-supplied transfer sheet P is conveyed by the pair of convey rollers 103 to reach the nip between the pair of regist rollers 104. After a predetermined loop is formed in the transfer sheet, the paired convey rollers 103 are stopped temporarily. Thereafter, the transfer sheet is conveyed to and adhered on the transfer belt 108 at a predetermined timing, as is in the first surface image formation. Then, the transfer sheet is passed through the first to fourth image forming stations 1Y, 1M, 1C, 1K to form a second image on the other (second) surface of the transfer sheet. Then, the second image is fixed in the fixing device.

On the other hand, when the second image formation is started, since the first sheet deflection solenoid (not shown) is turned OFF, the transfer sheet on which the second image was formed and in which the second image was fixed is directed to a pair of discharge rollers, and then is discharged onto a discharge tray. After a last transfer sheet was discharge, the image forming operation is finished.

[Image Process Portion]

Figures 3, 3A, 3B:
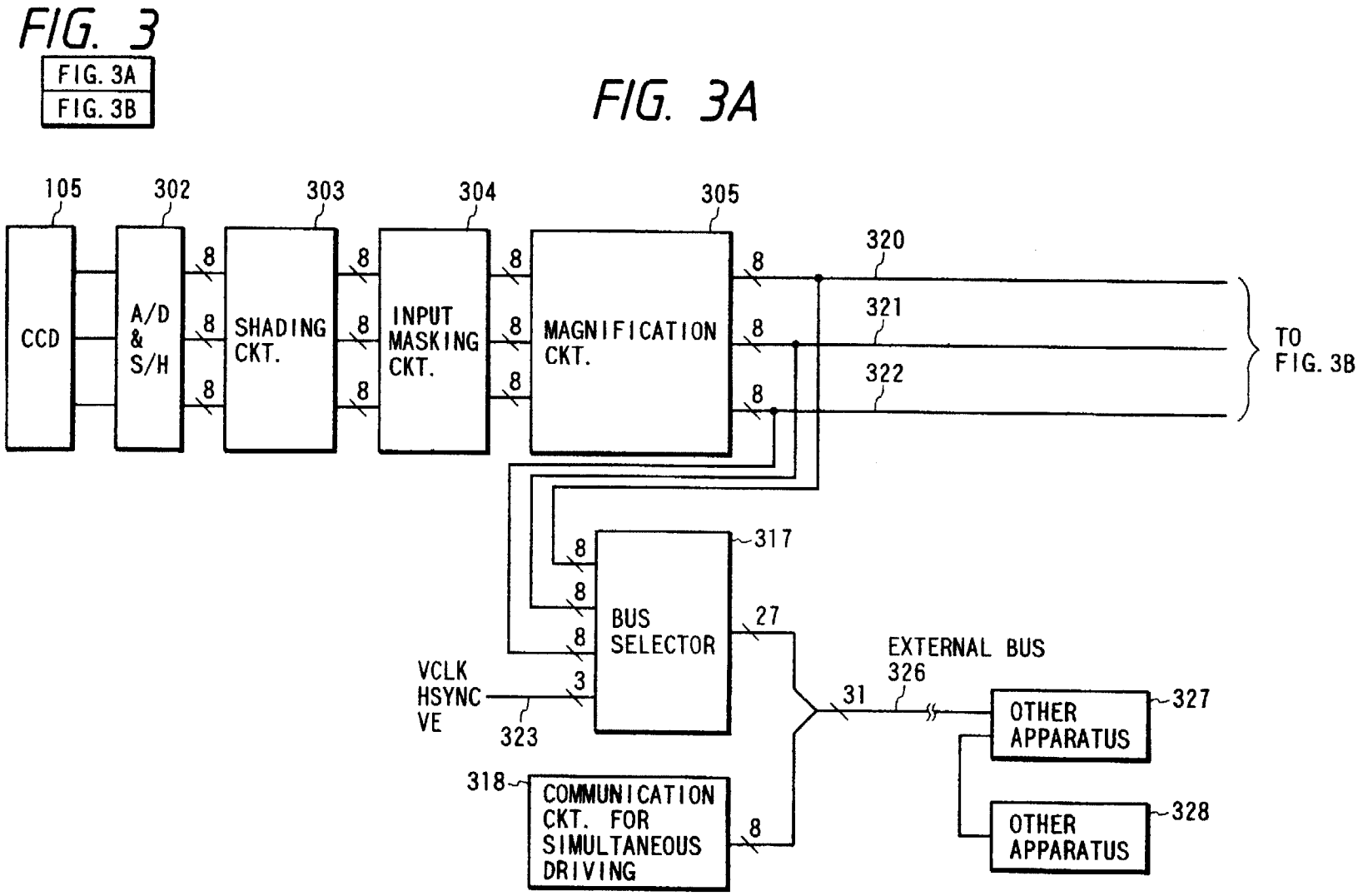
FIG. 3 which is comprised of FIGS. 3A and 3B is an explanatory view showing an image process circuit portion of the image forming apparatus of FIG. 1.
Figure 3B:
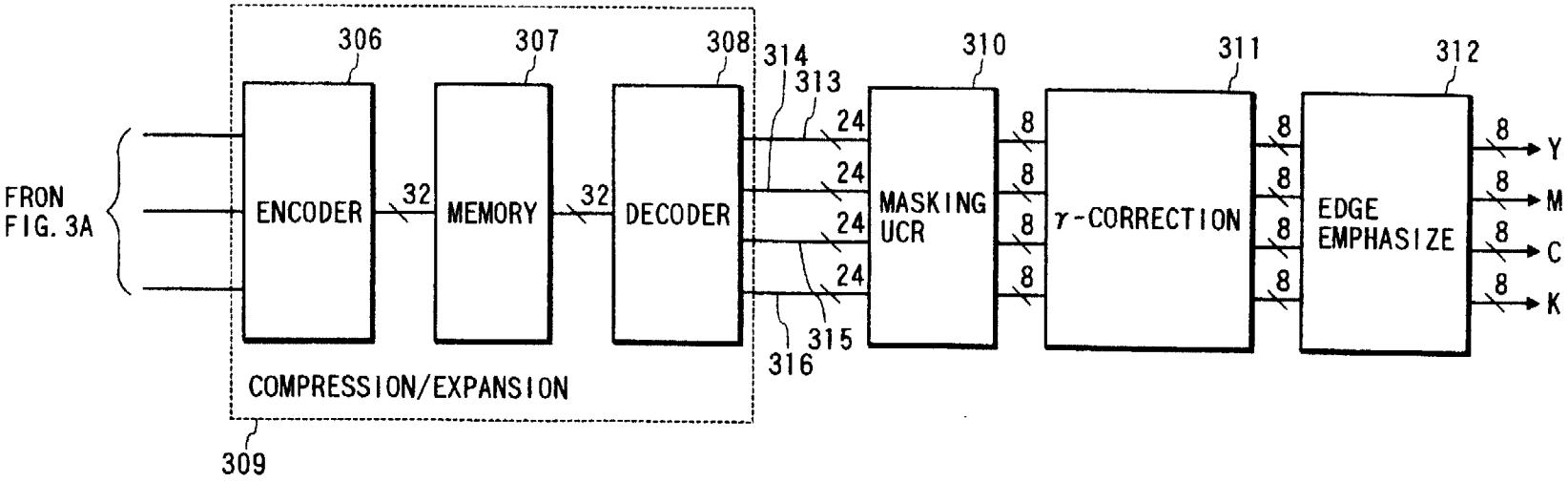
Figure 4:
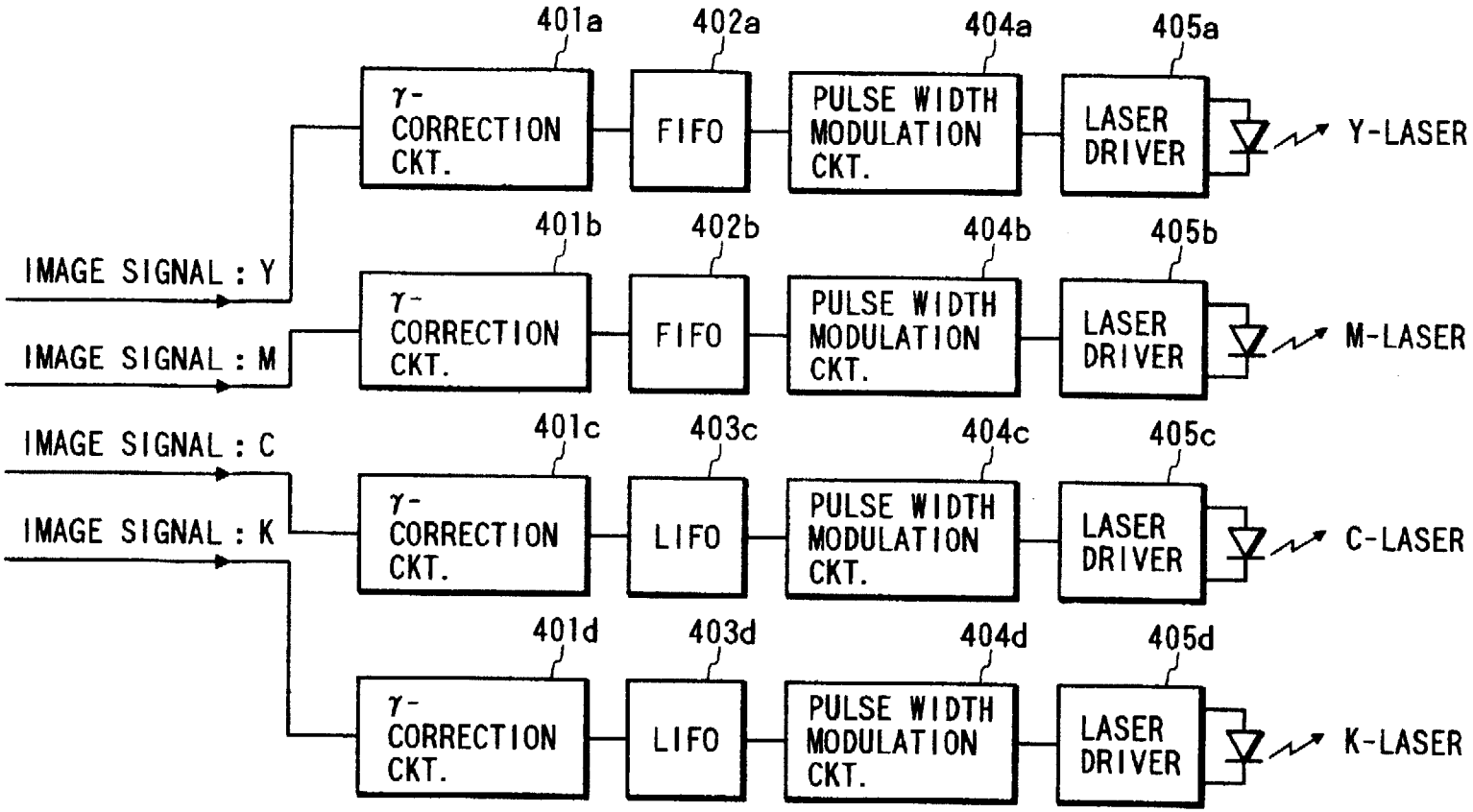
FIG. 4 is a block diagram for explaining an image data treating condition of a printer portion of the image forming apparatus of FIG. 1.

FIGS. 3A and 3B are explanatory views for explaining the construction of the image process portion shown in FIG. 4. Now, the construction and operation of the image process portion will be explained. Incidentally, FIGS. 3A and 3B show flows of the image signal (electric signal) from the reading of the CCD 105 to the output as a print signal.

The image data photo-taken by the CCD 105 is sample-held by an A/D & S/H circuit 302. Then, the image data is A/D-converted to generate RGB three color digital signals. The color-decomposed data are subjected to shading correction and black correction in a shading circuit 303, and then are subjected to NTSC correction in an input masking circuit 304. Then, the data are subjected to magnify process (enlarge/contraction) in a magnify process circuit 305, and then are sent to an image data compress portion 309.

In the compress portion 309, the image is compressed by an encoder portion 306 for compressing the image data, and the compressed image data is stored in a memory portion 307. The image data compressed and stored in the memory portion 307 are read in an enlarged form by an decoder portion 308 to generate signals 313 to 316 corresponding to toner signals used in the printer. The read image data are subjected to prearrangement treatment and masking treatment in a masking UCR circuit 310 and then are γ-converted in a γ-correction circuit 311, and then are subjected to edge emphasis in an edge emphasis circuit 312. Then, the data are sent to the printer portion.

Incidentally, in the illustrated embodiment, in order to achieve simultaneous drive function, there is provided a function for effecting signal-communication between the printer and external (another) devices.

When the signal is outputted to the another device, after the magnify process, signals 320 to 322 and signals 323 such as image synchronous signals VCLK, HSYNC, VE and the like are passed through a bus selector 317 and then are combined with a simultaneous drive control signal 325. The combined signal is sent to another devices 327, 328 through an external bus 326.

Further, when a signal is received from another device, the signal sent through the external bus 326 is introduced into the encoder portion 306 through the bus selector 317. A communicate circuit 318 for simultaneous drive utilizes four lines (communication lines and control lines) to effect communication between the circuit 318 and the external device(s), thereby achieving the synchronism of various sequences and communication of information.

FIG. 4 is a block diagram for explaining the image data processing condition of the printer portion shown in FIG. 1.

The Y (yellow), M (magenta), C (cyan) and K (black) image signals sent from the reader portion shown in FIG. 1 are γ-corrected by γ-correction circuits 401*a* to 401*d* in accordance with sensitivity of the photosensitive drums. Thereafter, the image data Y and the image data M are synchronized with each other by FIFO circuits 402*a*, 402*b*. Regarding the image data C and the image data K, since they are scanned by the laser scanner 120 in a mirror-image fashion, main scan data thereof are inverted (reversely rotated) by LIFO circuits 403*a*, 403*b* to achieve the synchronism. Thereafter, the color image signals are pulse-width modulated by pulse width modulate circuits 404*a* to 404*d*. In response to the modulated image signals, laser drivers 405*a* to 405*d* are driven as lasers.

[Image Synchronous Control]

Figure 5:
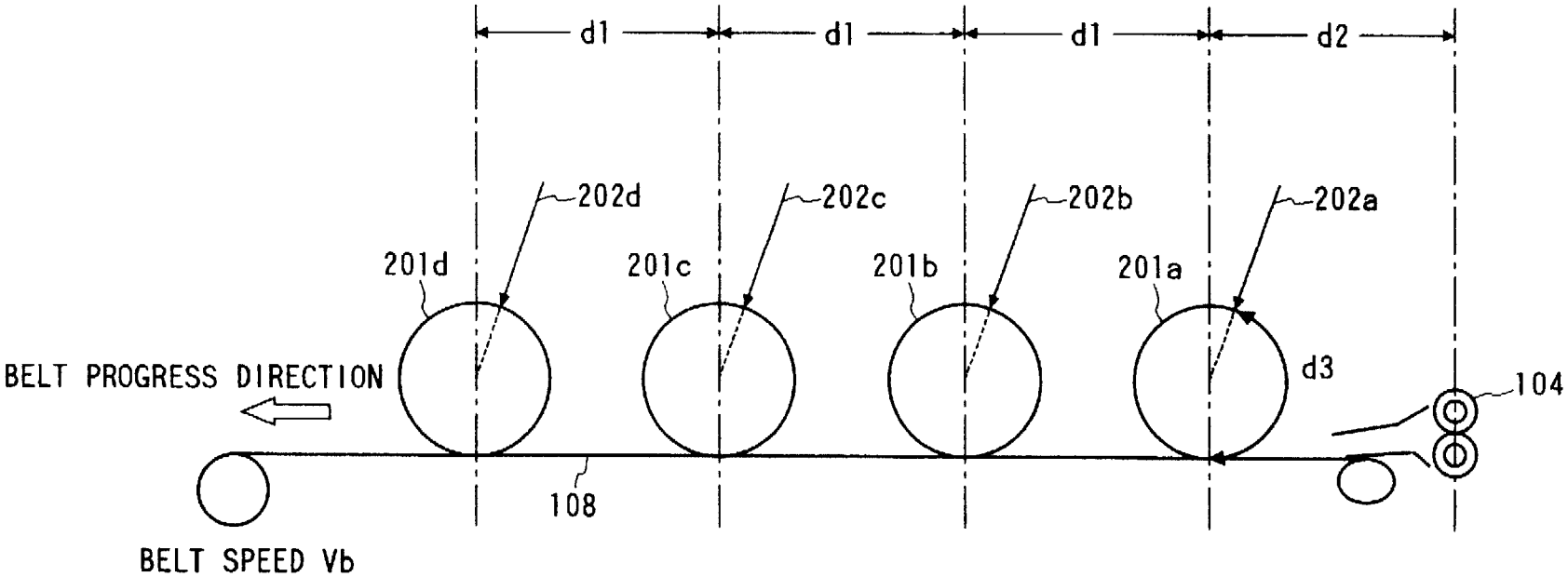
FIG. 5 is an explanatory view showing a positional relation between photosensitive drums in the printer portion of the image forming apparatus of FIG. 1.

FIG. 5 is a sectional view showing a positional relation between the photosensitive drums 201*a* to 201*d* of the printer portion shown in FIG. 1.

As shown in FIG. 5, the photosensitive drums are disposed side by side with a distance d1, and the transfer belt 108 conveys the transfer sheet P at a speed of Vb. By laser scan systems 202*a* to 202*d*, in response to the image information for respective colors, the photosensitive drums are exposed by the image light beams corresponding to the respective colors. Now, it is assumed that a distance from an image exposure position on the Y (yellow) photosensitive drum 201*a* and a contact position between the drum and the transfer belt is d3 and a distance from the nip of the regist rollers 104 to a center of the Y photosensitive drum 201*a* is d2.

Figure 6:
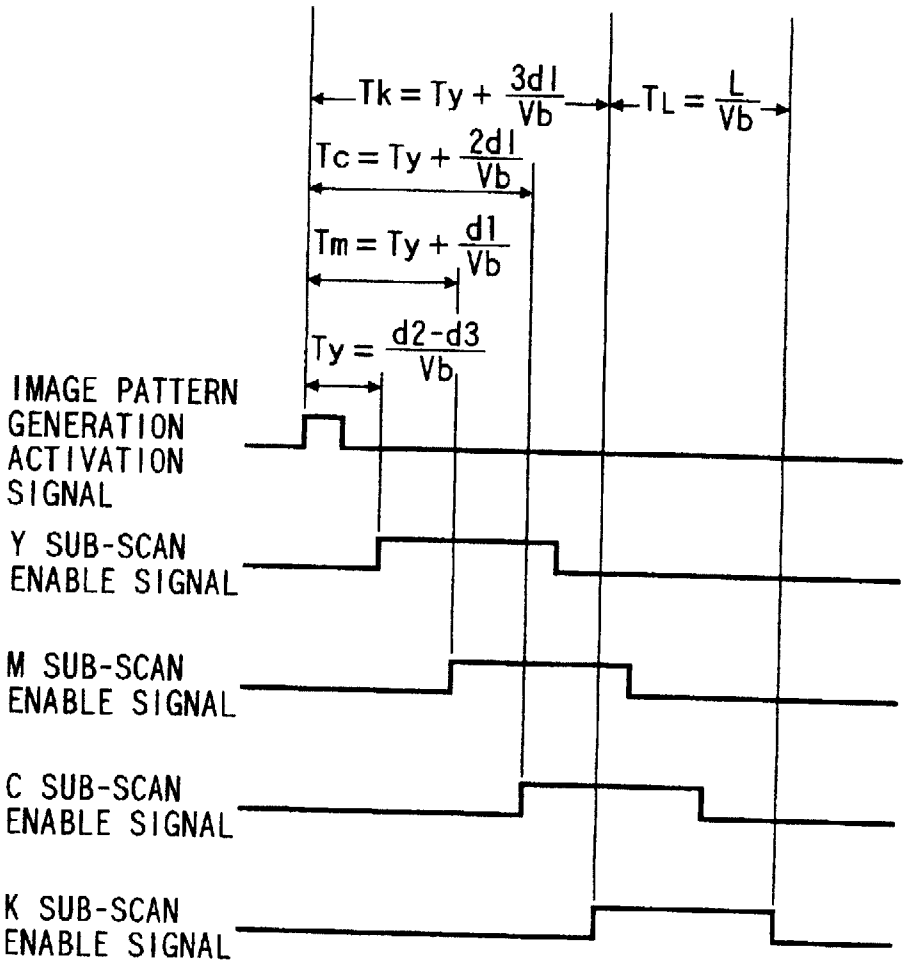
FIG. 6 is a timing chart showing exposure timings of sub-scans for exposing the photosensitive drums of FIG. 5.

Regarding this case, FIG. 6 shows exposure timings of sub-scans for exposing the photosensitive drums in such a manner that the image information of the original stored in the memory is successively transferred onto the transfer sheet in a superimposed fashion when the transfer sheet passes through the yellow (Y), magenta (M), cyan (C) and black (K) image forming stations.

FIG. 6 is a timing chart showing the exposure timings of sub-scans for exposing the photosensitive drums shown in FIG. 5.

In order to send the transfer sheet stopped by the regist rollers 104 to the transfer belt 108, an image pattern formation start signal is emitted at the same time when the regist rollers are driven. After the image pattern formation signal rises, enable signals (Y, M, C, K) rise at timings obtained from equations Ty=(d2−d3)/Vb, Tm=Ty+d1/Vb, Tc=Ty+2d1/Vb and Tk=Ty+3d1/Vb, respectively, and fall in accordance with a length of the transfer sheet in a sub-scan direction.

Figure 7:
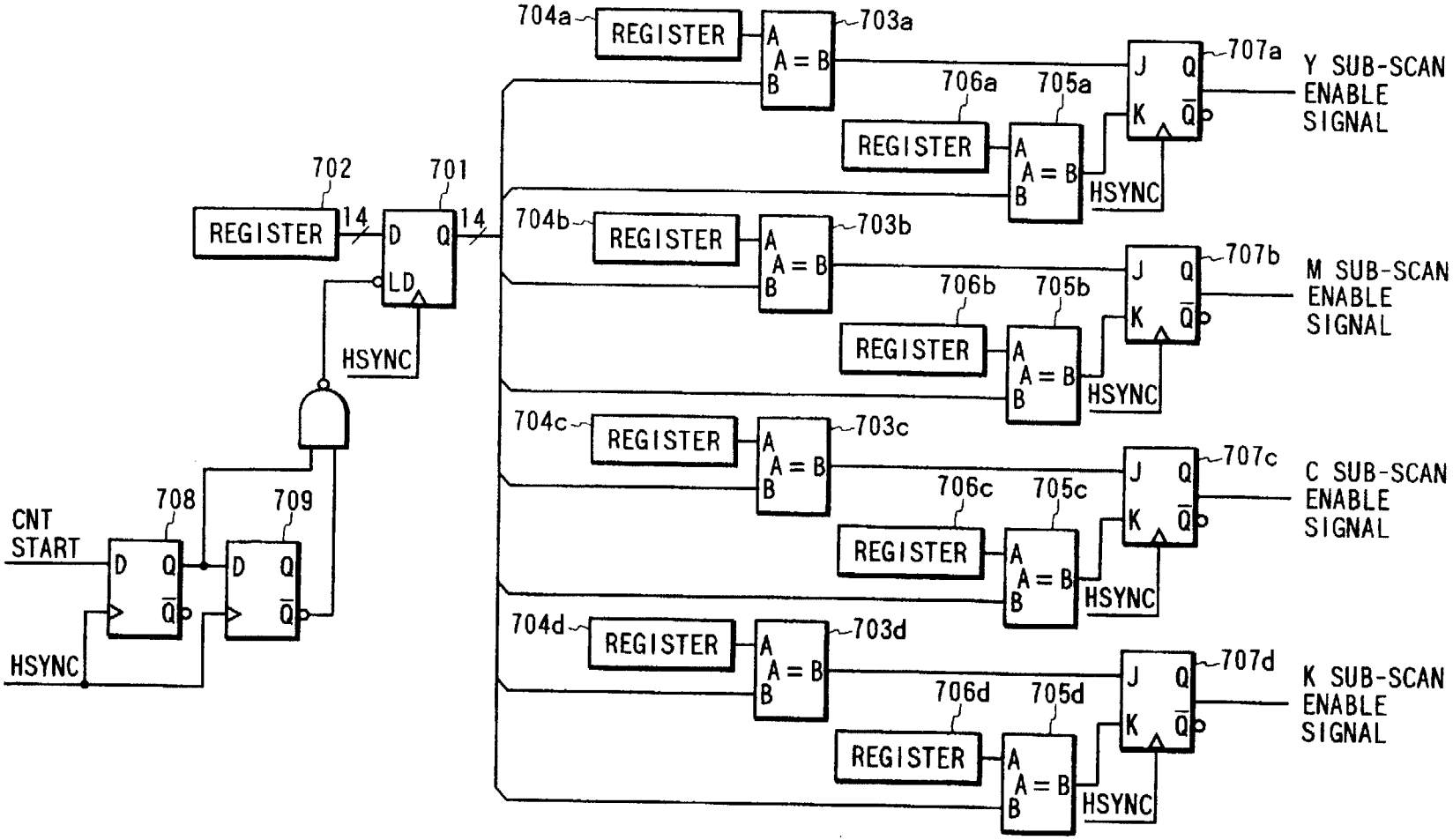
FIG. 7 is a block diagram showing an example of a circuit for generating sub-scan enable signals.

FIG. 7 is a block diagram showing an example of a circuit for generating the sub-scan enable signals shown in FIG. 6. Incidentally, in the illustrated embodiment, the time is counted by utilizing HSYNC in which one clock is generated whenever one-line is scanned.

In FIG. 7, a 14-bit counter 701 serves to count the number of HSYNCs in synchronous with main scan synchronous HSYNC. A register 702 serve to store a value loaded in the counter when an LOAD signal is generated, and data is written in the register by a CPU. In the illustrated embodiment, data "0" is written.

Comparators 703*a* to 703*d* serve to compare rising times of color image enable signals with each other. The count numbers of HSYNCs corresponding to the enable signals Ty, Tm, Tc, Tk are written in registers 704*a* to 704*d* for defining the rising times of the color sub-scan enable signals by the CPU, and, when the count coincides with the output of the 14-bit counter 701, a coincidence signal is emitted.

Comparators 705*a* to 705*d* serve to compare falling times of color image enable signals with each other. The count numbers of HSYNCs corresponding to the enable signals Ty, Tm, Tc, Tk are written in registers 706*a* to 706*d* for defining the falling times of the color sub-scan enable signals by the CPU, and, when the count coincides with the output of the 14-bit counter 701, a coincidence signal is emitted. When the length of the transfer sheet is L, a time duration Tp during which the enable signal is risen is represented by Tp=L/Vb.

Thus, values obtained by adding numerical values converted from Tp into HSYNC number to the values stored in the registers 704*a* to 704*d* are written in the registers 706*a* to 706*d*.

The image pattern formation start signal shown in FIG. 6 is inputted to an input CNT START of a flip-flop 708 shown in FIG. 7. The rising signal of the image pattern formation start signal is caught by two flip-flops 708, 709 and then is inputted to an input LOAD (LD) of the counter 701, thereby making the counter 701 clear for preparing the counting operation. The HSYNC numbers are successively counted by the counter 701. When the count value corresponding to the rise of the yellow (Y) enable signal is reached, the comparator 703*a* detects the coincidence and emits the coincidence signal.

The coincidence signal is inputted to a J terminal of a JK flip-flop 707*a*, so that the yellow (Y) sub-scan enable signal rises to a HI level. When the count is continued and the count value corresponding to the fall of the enable signal is reached, the comparator 705*a* detects the coincidence and emits the coincidence signal. The coincidence signal is inputted to a K terminal of a JK flip-flop 707*a*, so that the yellow (Y) sub-scan enable signal falls to a LOW level. Regarding magenta, cyan and black colors, sub-scan enable signals are generated in the same manner as the yellow sub-scan enable signal.

In the illustrated embodiment, the image forming apparatus has a simultaneous drive function for permitting the communication of image and/or information between devices by interconnecting a plurality of devices, so that an image scanned by a master device can be outputted from a slave device.

Figure 8:
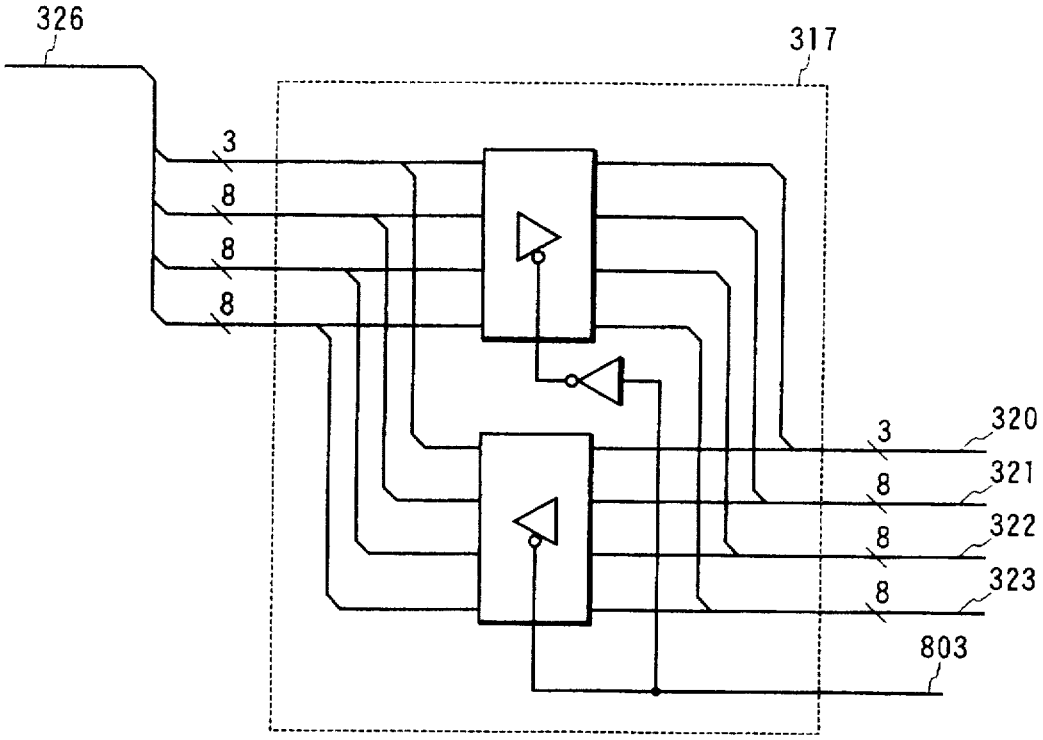
FIG. 8 is a block diagram of a bus selector shown in FIG. 3A.

FIG. 8 is a block diagram for explaining the bus selector 317 shown in FIG. 3A. The bus selector 317 controls the flow of the image information between the devices on the basis of the image signal and image synchronous signal.

When any device is operated as a slave device under the control of the CPU, a signal line 803 is controlled to bring a signal on the line to a HI level so that the image signal and image synchronous signal can be inputted from outside to inside. On the other hand, when any device is operated as a master device, the signal on the line 803 is brought to a LOW level by the CPU so that the image signal and image synchronous signal can be inputted from inside to outside.

[Belt Deflection Detection and Belt Deflection Control]

Figure 9:
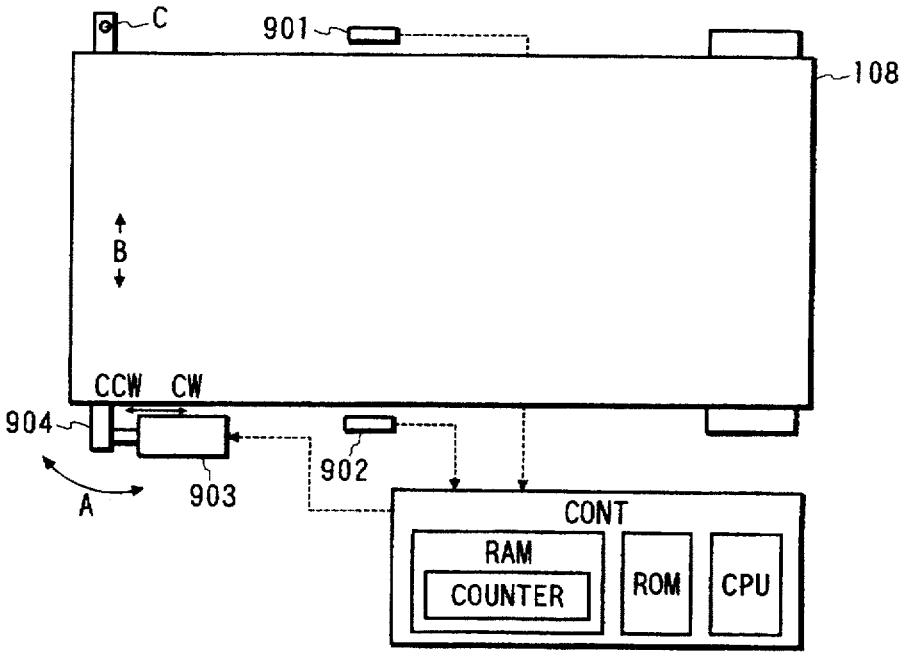
FIG. 9 is a plan view showing a transfer belt of FIG. 1 and therearound in detail.

FIG. 9 is a plan view showing the transfer belt shown in FIG. 1 and therearound.

In FIG. 9, there are provided sensors 901, 902 for detecting lateral edges of the belt to detect the belt deflection in a direction perpendicular to a transfer sheet conveying direction. Now, the sensor disposed at a front side of the apparatus is called as a belt front end detection sensor 901 and the sensor disposed at a rear side of the apparatus is called as a belt rear end detection sensor 902.

A motor shaft of a pulse motor 903 for controlling the belt deflection is connected to a transfer belt convey shaft 904 for conveying the transfer belt 108. The pulse motor 903 is controlled in such a manner (which will be described later) that, when a length of the motor shaft of the pulse motor is changed, the inclination angle of the convey shaft 904 pivotally supported at one end C are changed as shown by the arrow A, thereby changing the shifting direction of the belt. Incidentally, the symbol CONT denotes a control portion including a CPU, a ROM and a RAM including a counter.

Figure 10:
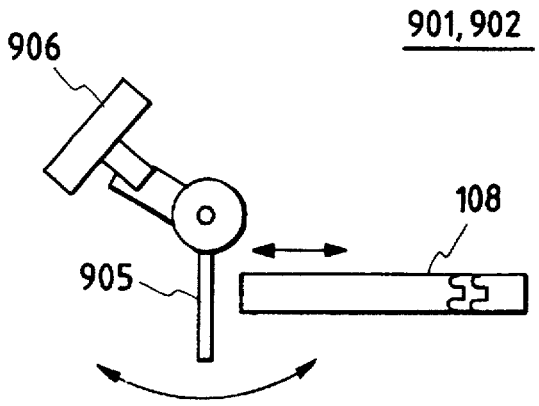
FIG. 10 is a view showing a detection sensor for detecting belt deflection.

FIG. 10 shows the belt front end detection sensor 901 and the belt rear end detection sensor 902 in detail.

As shown in FIG. 10, each of the detection sensors 901, 902 includes an actuator 905 and a photo-interrupter 906. If the transfer belt 108 is shifted toward the front side of the image forming apparatus, the actuator 905 is urged by the lateral edge of the belt. As a result, the photo-interrupter 906 detects the passing of light, thereby detecting the deflection of the belt.

Next, the summary of the illustrated embodiment will be described with reference to FIGS. 9 and 10.

In the image forming apparatus, there are provided a plurality of image forming stations disposed side by side and including a latent image forming means (laser scanner 120) for scanning photosensitive members with laser beams to-form latent images and a developing means (developing device 204*a* and the like) for developing, with toner, the latent images formed on the photosensitive members to form color toner images, and a convey means (transfer belt 108) for conveying a transfer sheet, whereby a full-color image is formed by transferring the color toner images formed in the image forming stations onto the transfer sheet conveyed by the convey means in a superimposed fashion. The image forming apparatus further comprises a plurality of detection means (detection sensors 901, 902) for detecting the belt deflection of the convey means in a sub-direction perpendicular to a convey direction of the convey means, a counting means (counter in the control portion CONT) for effecting a counting operation in accordance with an output from the detection means, a rocking drive means (pulse motor 903) for rocking a convey shaft of the convey means for a predetermined amount, and a control means (CPU in the control portion CONT) for controlling the rocking of the rocking drive means on the basis of the comparison between the counted value counted by the counting means and a threshold value (stored in ROM of the control portion CONT), whereby the rocking of the rocking drive means (pulse motor 903) is controlled by the control portion CONT on the basis of the comparison between the counted value (time period during which the belt deflection is being detected by the detection means 901, 902) of the counter and the stored threshold value, so that the belt deflection is gradually corrected to return the convey belt to its normal position without causing transfer-shift (transfer deviation).

Further, in the image forming apparatus, the control means (CPU in the control portion CONT) controls the pulse motor 903 in such a manner that the transfer belt is rocked by a predetermined amount on the basis of the counted value counted by the counting means and the threshold values (FIG. 15) having different intervals depending upon the number of rocking operation, thereby gradually correcting the belt deflection to return the convey belt to its normal position while changing the rocking interval without causing transfer-shift.

In the image forming apparatus, the pulse motor 903 rocks the convey shaft 904 for conveying the transfer belt 108 in directions shown by the arrow A in FIG. 9 so that the belt deflection can be corrected by changing the shifting direction of the transfer belt. Incidentally, by rocking the convey shaft, the convey shaft is inclined with respect to the conveying direction by a predetermined angle.

In the image forming apparatus, the rocking drive means is constituted by a pulse motor 903 such as a stepping motor so that the rocking amount of the convey shaft for the transfer belt 108 can be controlled with high accuracy.

In the image forming apparatus, there are further provided a calculation means (CPU in the control portion CONT) for calculating a deflecting speed of the convey means on the basis of the time period during which the belt deflection is being detected by the detection sensor 901 or 902, and a recovery means (CPU in the control portion CONT) for correcting the rocking amount of the rocking drive means rocked by the control means on the basis of comparison between the deflecting speed calculated by the calculation means and a predetermined deflection speed (and for recovering the rocking amount within a predetermined deflecting speed) range, whereby the rocking amount of the rocking drive means rocked by the control means is corrected by the recovery means to recover the deflecting speed within the predetermined deflecting speed range on the basis of the comparison result between the deflecting speed calculated by the calculation means and the predetermined deflecting speed, so that, even when the deflecting speed of the transfer belt 108 is fast, the belt deflection is gradually corrected to return the convey belt to its normal position swiftly while changing the rocking interval without causing transfer-shift.

[Belt Deflection Control]

Figure 11:
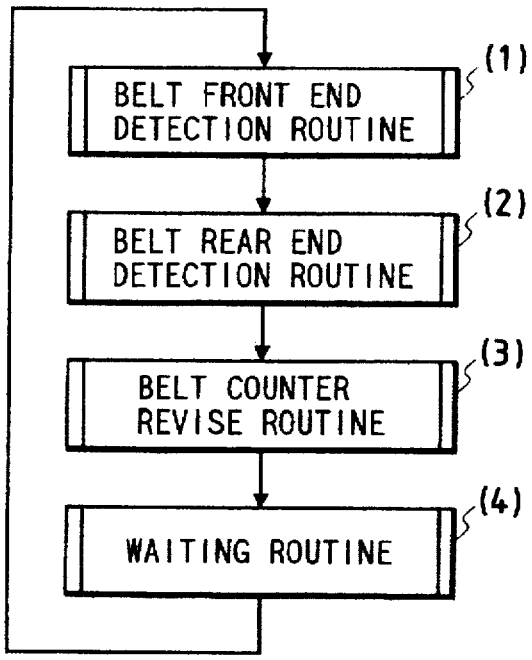
FIG. 11 is a flow chart showing measuring and treating a belt deflection time in the image forming apparatus according to the present invention.

FIG. 11 is a flow chart showing a program for measuring a belt deflection time in an image forming apparatus according to the present invention. The belt deflection time measuring program generally includes four routines, i.e., (1) belt front end detect routine, (2) belt rear end detect routine, (3) belt counter renewal routine, and (4) predetermined time wait routine. Incidentally, the belt detection operation of the sensor is effected every 0.1 sec.

Figure 12:
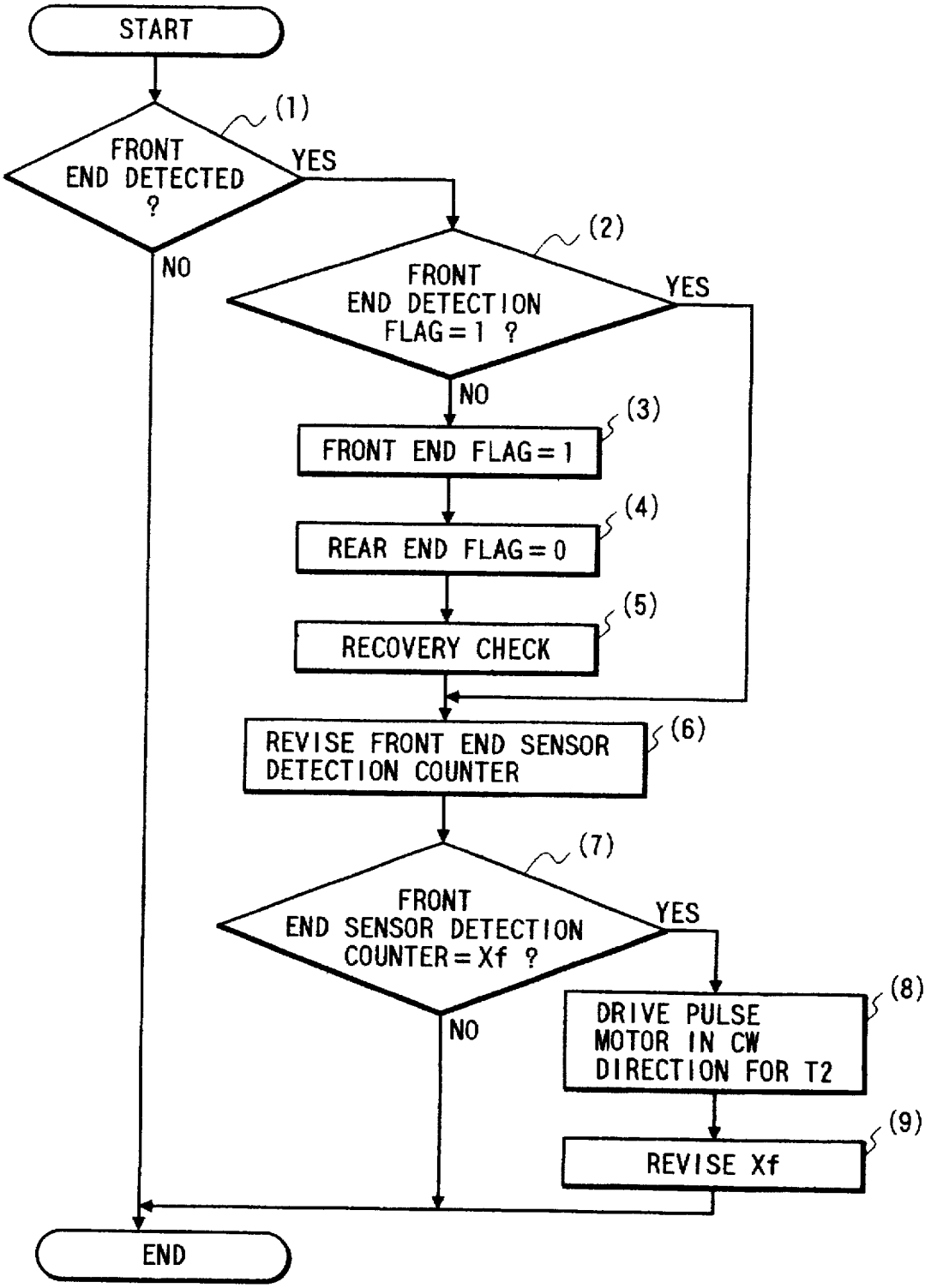
FIG. 12 is a flow chart showing a belt front end detect routine shown in FIG. 11 in detail.

FIG. 12 is a flow chart showing the belt front end detect routine shown in FIG. 11 in detail. Incidentally, (1) to (9) indicate steps.

In FIG. 12, first of all, it is judged whether the belt is detected by the belt front end detection sensor 901 (step 1). If the belt is detected by the sensor, it is judged whether the belt front end detection flag is "1" or not (step 2). If the belt front end detection flag is "1", since it means that the belt is already detected by the sensor 901, the program goes to a step 6.

On the other hand, in the step 2, if it is judged that the belt front end detection flag is "0", since it means that the belt is not detected by the previous detecting operation of the sensor 901 and the belt is shifted from the centered position toward the front side this time, the belt front end detection flag is set to "1" (step 3), and a belt rear end detection flag is set to "0" (step 4).

Then, a recovery check for effecting recovery treatment for driving the rock motor (pulse motor) when the shifting speed of the belt from the rear side to the front side is faster than a predetermined value is executed (step 5). The recovery check will be described later.

Then, the belt front end detection counter is renewed or revised by "1" (step 6), and, it is judged whether the detected value of the belt front end detection sensor is equal to a threshold value Xf (step 7). If not equal, the program is ended. Whereas, if equal, the CPU drives the pulse motor in a clockwise direction for a time duration T2 not affecting an influence upon the image (step 8). That is to say, the detecting operation of the sensor is effected every predetermined time (0.1 sec in the illustrated embodiment), and, whenever the belt front end is detected, the counter is renewed, and, only when the counted value of the counter becomes equal to the predetermined value (i.e., only when the time duration during which the belt front end is detected reaches the predetermined value), the pulse motor is driven. After the pulse motor is driven, a next threshold value Xf is revised. Incidentally, the detailed values of the threshold will be described later.

Figure 13:
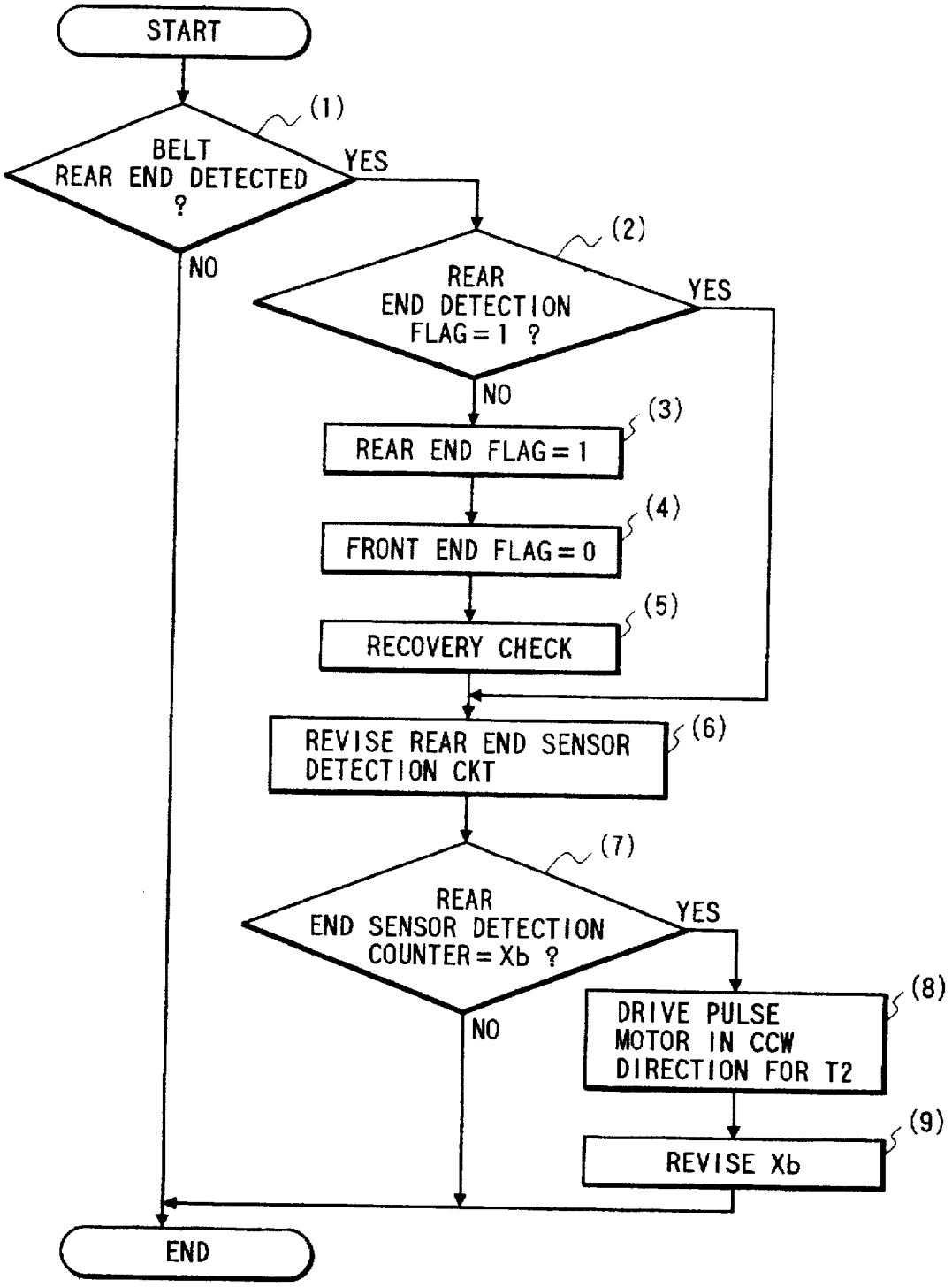
FIG. 13 is a flow chart showing a belt rear end detect routine shown in FIG. 11 in detail.

FIG. 13 is a flow chart showing the belt rear end detect routine shown in FIG. 11 in detail. Incidentally, (1) to (9) indicate steps. Further, as mentioned above, the belt detection operation of the sensor is effected every 0.1 sec.

In FIG. 13, first of all, it is judged whether the belt is detected by the belt rear end detection sensor 902 (step 1). If the belt is detected by the sensor, it is judged whether the belt rear end detection flag is "1" or not (step 2). If the belt rear end detection flag is "1", the program goes to a step 6.

On the other hand, in the step 2, if it is judged that the belt rear end detection flag is "0", since it means that the belt is shifted from the centered position toward the rear side, the belt rear end detection flag is set to "1" (step 3), and the belt front end detection flag is set to "0" (step 4).

Then, a recovery check for effecting recovery treatment for driving the rock motor (pulse motor) when the shifting speed of the belt from the front side to the rear side is faster than a predetermined value is executed (step 5). The recovery check will be described later.

Then, the belt rear end detection counter is renewed or revised by "1" (step 6), and, it is judged whether the detected value of the belt rear end detection sensor is equal to a threshold value Xb (step 7). If not equal, the program is ended. Whereas, if equal, the CPU drives the pulse motor in a counter-clockwise direction for a time duration T2 not affecting an influence upon the image (step 8). Then, a next threshold value Xb is revised. Incidentally, the detailed value of the threshold will be described later.

[Belt Rocking Pulse Motor Driving Time Threshold Values]

As mentioned above, an interval between a certain threshold value for determining the timing for driving the belt rocking pulse motor 903 and a next threshold value is varied with the total time period during which the belt end is being detected and the belt rocking pulse motor driving time period.

The reason why the drive timing is determined on the basis of the total time period during which the belt end is being detected will be explained.

Figure 14:
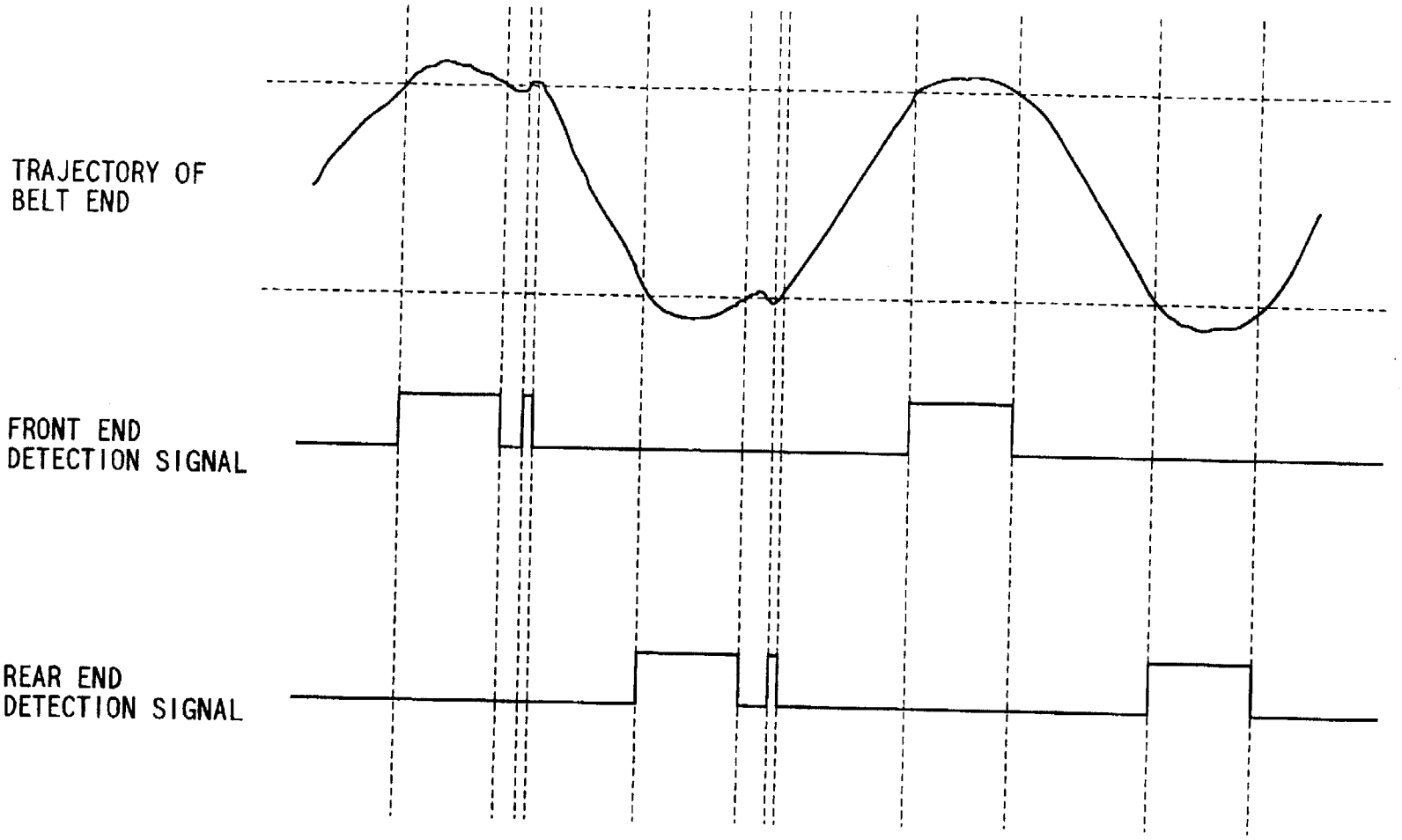
FIG. 14 is a view showing the correspondence between a rocking trace of the transfer belt end shown in FIG. 9 and outputs of detection sensors.

FIG. 14 is a view showing the correspondence between the rocking trace of the belt end and the outputs of the detection sensors.

As shown in FIG. 14, even if the belt is once shifted from the side position to the centered position not to be detected by the detection sensor, the belt end may be detected by the sensor again.

The reason is that the belt is not always shifted to a given direction at a constant speed as shown in FIG. 14, but may be shifted along a hysteresis loop or the belt end shifting trace may be varied with the position of the belt end. In this way, when the fact that, after the rocking direction of the belt is once changed, the belt may be returned again is taken into consideration, it is preferable, for the correct control, that the pulse motor driving time period is changed by using the total detection value of the belt end detection sensors.

Figures 15, 16:
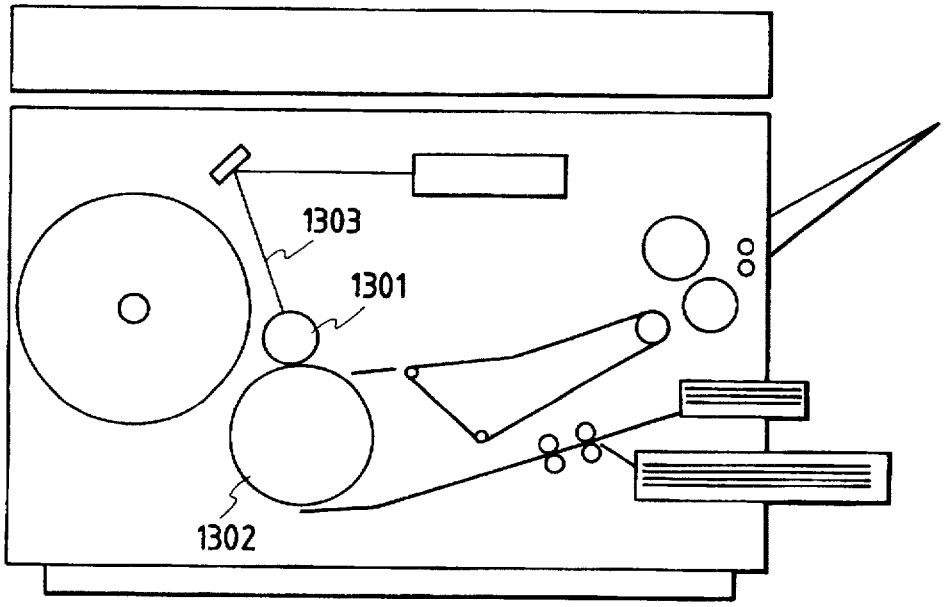
FIG. 16 PRIOR ART
FIG. 15 is a view showing a relation between the number of operations of a pulse motor shown in FIG. 9 and threshold values.
FIG. 16 is a sectional view of a conventional image forming apparatus.

FIG. 15 shows a relation between the number of motor operations and the threshold values.

Incidentally, as mentioned above, the time counter utilizes the total detection value of the belt end detection sensors. Briefly explaining, when the belt is initially detected by the sensor, first of all, the motor is driven, and, in the next time, when the value of the belt end detection counter reaches "50", the motor is driven again. Similarly, the motor is driven when the counter value reaches "150", "400", . . . , respectively. According to the illustrated embodiment, the interval between a given threshold value and the next threshold value is increased as the number of motor operations is increased.

[Recovery Treatment Check]

When the rocking speed of the belt is fast, even when the pulse motor is driven in the normal sequence as mentioned above, since it takes a relatively long time to change the rocking direction of the belt, in the illustrated embodiment, the recovery treatment is performed in accordance with the rocking speed.

More specifically, on the basis of the belt rocking speed time periods Tfb (from front end to rear end) and Tbf (from rear end to front end), the following calculations are carried out. When the belt rocking time period T is long, i.e., when the rocking speed is slow ($T>Tth$), $P=0$; whereas, when the belt rocking time period T is short, i.e., when the rocking speed is high ($T\leqq Tth$), $P=C(Tth-T)+Pinit$. Where, P is the number of pulses when the motor is driven exceptionally, C is constant, Tth is a threshold time derived from a rocking time design average value of the belt, and T is a detected belt rocking time period (Tfb or Tbf) wherein Tfb is used when the belt is being shifted from the front side to the rear side (upper side to lower side in FIG. 9) and Tbf is used when the belt is being shifted from the rear side to the front side. Further, Tinit (predetermined number of pulses driven every time) means the number of pulses driven when the detected time period T is smaller than Tth and is previously determined in consideration of the feature of the apparatus.

For example, the belt rocking speed time period Tfb is calculated as follows.

By subtracting a time duration Tf2 during which the belt is continuously detected by the front end detection sensor 901 from a time duration Tf1 from when the transfer belt 108 shifted from the centered position toward the front side is detected by the front end detection sensor 901 to when the belt returned toward the centered position is detected by the rear end detection sensor 902, the belt rocking speed time period Tfb can be obtained (i.e., Tfb=Tf1−Tf2). This time period physically represents a time period during which the belt is being shifted from the front side to the rear side.

Similarly, the belt rocking speed time period Tbf is calculated as follows.

By subtracting a time duration Tb2 during which the belt is continuously detected by the front end detection sensor 901 from a time duration Tb1 from when the transfer belt 108 shifted from the centered position toward the rear side is detected by the rear end detection sensor 902 to when the belt returned toward the centered position is detected by the front end detection sensor 901, the belt rocking speed time period Tbf can be obtained (i.e., Tbf=Tb1−Tb2). This time period physically represents a time period during which the belt is being shifted from the front side to the rear side.

By the above calculations, if the rocking speed of the belt is faster than the predetermined value, when the belt end is detected, the motor 903 is driven exceptionally by P pulses more than the normal condition, thereby effecting the exceptional treatment (recovery treatment). On the Other hand, when the rocking speed of the belt is slower than the predetermined value, the recovery treatment (for driving the motor exceptionally) is not performed.

Next, the summary of the illustrated embodiment will be described with reference to FIGS. 12 and 13.

In the image forming apparatus, there are provided a plurality of image forming stations disposed side by side and including a latent image forming means (laser scanner 120) for scanning photosensitive members with laser beams to form latent images and a developing means (developing device 204*a* and the like) for developing, with toner, the latent images formed on the photosensitive-members to form color toner images, and a convey means (transfer belt 108) for conveying a transfer sheet, whereby a full-color image is formed by transferring the color toner images formed in the image forming stations onto the transfer sheet conveyed by the convey means in a superimposed fashion. The image forming apparatus performs a detecting step (steps 1, 2 in FIGS. 12 and 13) for detecting the belt deflection of the convey means in a sub-direction perpendicular to a convey direction of the convey means, a counting step (steps 1, 2 in FIGS. 12 and 13) for counting the time period during which the deflection condition is being detected, a comparing step (steps 7 in FIGS. 12 and 13) for comparing the counted value and a stored threshold value, a rocking step (steps 8 in FIGS. 12 and 13) for rocking a rocking drive means on the basis of the comparison, and a renewal step (steps 9 in FIGS. 12 and 13) for revising the threshold value, whereby the belt deflection is gradually corrected to return the convey belt to its normal position without causing transfer-shift (transfer deviation).

In the image forming apparatus, a calculating step (steps 5 in FIGS. 12 and 13) for calculating a deflecting speed of the convey means on the basis of counted value, and a recovery step (steps 5, 8 in FIGS. 12 and 13) for correcting the rocking amount of the rocking drive means rocked by the control means on the basis of comparison between the calculated deflecting speed and a predetermined deflecting speed and for recovering the deflecting speed within a predetermined deflecting speed range are carried out, whereby, even when the deflecting speed of the transfer belt 108 is fast, the belt deflection is gradually corrected to return the convey belt to its normal position swiftly while changing the rocking interval without causing transfer-shift.

According to the illustrated embodiment, since, when the actuator is urged by the belt end to detect the belt deflection, the shaft for conveying the belt is reduced by driving the pulse motor, thereby controlling the belt deflection by changing the shifting direction of the belt, and, since the time period during which the belt deflection is being detected is counted so that, when the counted value exceeds the threshold value, the rocking direction is changed, and further since the interval between the threshold values is changed in accordance with the number of the motor operations to change the interval of the driving of the pulse motor, the belt deflection can be gradually corrected without causing the transfer-shift which may cause the deterioration of the image when the belt deflecting direction is changed.

The present invention is not limited to the above-mentioned embodiments, but various alterations and modifications can be adopted within the scope of the invention.

What is claimed is:

1. An image forming apparatus comprising:

a convey belt for bearing and conveying a recording material;

an image forming means for forming an image on the recording material born on said convey belt;

detection means for detecting a position of said convey belt in a direction perpendicular to a recording material conveying direction provided by said convey belt;

count means for counting a time period in which said convey belt is located out of a predetermined area in a direction perpendicular to the convey direction based on a detected output from said detection means;

rocking means for rocking said convey belt in the direction perpendicular to the recording material conveying direction; and control means for controlling a rocking operation of said rocking means based on a counted value of said count means.

2. An image forming apparatus according to claim 1, wherein said control means judges whether the rocking operation of said rocking means is effected on the basis of said counted value, and wherein an interval between the rocking operation of said rocking means and the next rocking operation is increased as the number of rocking operations of said rocking means is increased.

3. An image forming apparatus according to claim 1, wherein said rocking means rocks a shaft for supporting said convey belt.

4. An image forming apparatus according to claim 3, wherein said rocking means includes a pulse motor.

5. An image forming apparatus according to claim 3, wherein said rocking means increases tilt of a shaft supporting said convey belt as the counted value increases to move said convey belt in one of the directions perpendicular to the conveying direction.

6. An image forming apparatus according to claim 1, wherein said rocking means includes a pulse motor.

7. An image forming apparatus according to claim 1, further comprising a second control means for controlling to increase the number of rocking operations of said rocking means when a rocking speed of said convey belt exceeds a predetermined value, in comparison with when said rocking speed is smaller than said predetermined value.

8. An image forming apparatus according to claim 1, wherein said detection means comprises a first sensor disposed in the vicinity of one end of said convey belt in the direction perpendicular to the recording material conveying direction, and a second sensor disposed in the vicinity of the other end of said convey belt in the direction perpendicular to the recording material conveying direction.

9. An image forming apparatus according to claim 8, further comprising a second control means for controlling to increase the number of rocking operations of said rocking means when a rocking speed of said convey belt exceeds a predetermined value, in comparison with when said rocking speed is smaller than said predetermined value.

10. An image forming apparatus according to claim 1, wherein said image forming means includes an image bearing member, and a transfer means for transferring the image from said image bearing member to the recording material born on said convey belt.

11. An image forming apparatus according to claim 10, wherein said image bearing member comprises an electrophotographic photosensitive member.

12. An image forming apparatus according to claim 1, wherein said image forming means includes a plurality of image bearing members, and transfer means for transferring the images from said plural image bearing members to the recording material born on said convey belt in a superimposed fashion.

13. An image forming apparatus according to claim 12, wherein said image bearing member comprises an electrophotographic photosensitive member.

14. An image forming apparatus according to claim 1, a rocking force of said convey belt by said rocking means is variably controlled based on the counted value.

15. An image forming apparatus according to claim 14, wherein the rocking force increases as the counted value increases.

16. An image forming apparatus according to claim 1, wherein said control means determines whether to perform the rocking operation by said rocking means based on the counted value or not.

17. An image forming apparatus according to claim 16, wherein said control means performs the rocking operation by said rocking means when the counted value is larger than the predetermined value, but does not perform it when the counted value is smaller than the predetermined value.

* * * * *

UNITED STATES PATENT AND TRADEMARK OFFICE

CERTIFICATE OF CORRECTION

PATENT NO. : 5,754,932

DATED : May 19, 1998

INVENTOR(S) : Motoaki TAHARA

It is certified that error appears in the above-identified patent and that said Letters Patent is hereby corrected as shown below:

COLUMN 5:

Line 3, "an" (2nd occurrence) should read --a--
Line 15, "another" should read --other--.

COLUMN 6:

Line 21, "synchronous" should read --synchronism--.

COLUMN 7:

Line 38, "are" should read --is--.

Signed and Sealed this

First Day of December, 1998

*Attest:*

*Attesting Officer*

Bruce Lehman

BRUCE LEHMAN

*Commissioner of Patents and Trademarks*